United States Patent [19]

Wagstaff

[11] Patent Number: 5,040,595

[45] Date of Patent: Aug. 20, 1991

[54] MEANS AND TECHNIQUE FOR DIRECT COOLING AN EMERGING INGOT WITH GAS-LADEN COOLANT

[75] Inventor: Frank E. Wagstaff, Spokane, Wash.

[73] Assignee: Wagstaff Engineering Incorporated, Spokane, Wash.

[21] Appl. No.: 393,448

[22] Filed: Aug. 14, 1989

[51] Int. Cl.[5] ..... B22D 11/04; B22D 11/124

[52] U.S. Cl. ..... 164/487; 164/444

[58] Field of Search ..... 164/487, 486, 444, 415

[56] References Cited

U.S. PATENT DOCUMENTS

| | | | |
|---|---|---|---|
| 3,713,479 | 1/1973 | Bryson | 164/487 |
| 4,166,495 | 9/1979 | Yu | 164/486 |
| 4,200,138 | 4/1980 | Hildebrandt | 164/415 X |
| 4,597,432 | 7/1986 | Collins et al. | 164/487 X |
| 4,598,763 | 7/1986 | Wagstaff et al. | 164/487 X |
| 4,693,298 | 9/1987 | Wagstaff | 164/486 |
| 4,732,209 | 3/1988 | Apostolou et al. | 164/444 X |

FOREIGN PATENT DOCUMENTS

| | | | |
|---|---|---|---|
| 431954 | 11/1974 | U.S.S.R. | 164/415 |
| 499034 | 7/1976 | U.S.S.R. | 164/415 |
| 2082950A | 3/1982 | United Kingdom | 164/444 |

*Primary Examiner*—J. Reed Batten, Jr.

*Attorney, Agent, or Firm*—Christopher Duffy

[57] ABSTRACT

A body of partially solidified metal emerging as ingot from the exit end of an open-ended mold, is direct cooled by discharging liquid coolant onto the surface of the ingot through a passage of the mold opening into the exit end of the mold at an aperture therein; and at times, such as in the butt-forming stage, by the added step of forcing pressurized gas into the coolant through a body of solid but porous, gas-permeable material incorporated into the wall of the passage at a surface thereof which extends generally parallel to the flow of coolant in the passage and coterminates with the exit end of the mold at the aperture to form an edge thereof. When the gas is added, the coolant discharges through the aperture in a discontinuous liquid phase in which it is laden with bubbles of undissolved gas that will alter the heat transfer characteristics of the coolant on the surface of the ingot to vary the rate at which heat is lost therefrom.

63 Claims, 5 Drawing Sheets

MEANS AND TECHNIQUE FOR DIRECT COOLING AN EMERGING INGOT WITH GAS-LADEN COOLANT

DESCRIPTION

1. Technical Field

This invention relates to a means and technique for direct cooling a body of partially solidified metal emerging as ingot from the exit end of an open-ended mold by the steps of discharging liquid coolant onto the surface of the ingot through a passage of the mold which opens into the exit end of the mold at an aperture therein and, when desired, such as in the formation of the butt of the ingot, infusing the coolant with gas so that when the coolant discharges from the aperture, it is laden with gas which alters its heat-transfer characteristics on the surface of the ingot and reduces the rate at which the coolant extracts heat from the ingot. More particularly, the invention relates to a means and technique of this nature wherein the coolant is infused with gas in the passage, at a pressure of less than that which is needed to dissolve the gas in the coolant, so that the coolant then discharges through the aperture in a discontinuous liquid phase in which it is laden with bubbles of undissolved gas that have the effect mentioned when the coolant reaches the surface of the ingot.

2. Background Art

In U.S. Pat. No. 4,166,495, Yu infused the coolant with gas to achieve this effect, but the coolant was infused with gas by the mechanism of dissolving it in the coolant under pressure, and then the gas/coolant solution was kept under pressure as it was directed through the mold to the ingot, where, of course, the gas came out of solution and was observed as reducing the rate at which heat was lost from the surface of the ingot. The gas was infused in the coolant only during the formation of the butt of the ingot, however, and after the butt was formed, Yu commonly discontinued the supply of gas and resumed discharging ordinary, unmodified coolant onto the ingot during the formation of the remainder of the ingot in the steady state casting stage.

Unfortunately, Yu's mechanism for transporting the gas to the ingot, produces a number of problems for those called on to operate the Yu process in practice. The problems arise in the fact of having to dissolve the gas in the liquid coolant, and in the practical consequences of that step when the coolant reaches the surface of the ingot. In practice, most operators employ closed coolant systems in which they capture and reuse the spent coolant for subsequent casting operations. Not only is there considerable variation in the temperature of the coolant from one operation to the next, but also considerable variation in the number and concentration of various solutes, because of the need, among others, to treat the coolant for the control of algae growth. Of course, each time anything is done to alter the solubility of the gas with which the coolant is to be infused, the operator must compensate for this by adjusting the pressure of the gas, and on the whole, the process often proves to be extremely delicate to control.

Each operator is also faced with problems in assuring that the gas will come out of solution in the desired manner at the surface of the ingot. Like it or not, this is a function of the many factors of surface temperature, the relative smoothness or roughness of the surface, the availability of particle matter in the coolant to provide second phase nucleation sites for the gas, and the absence or presence of mechanical disturbance in the overall cooling system, tending to "excite" the gas into nucleating prematurely or in amounts exceeding that desired. Again, these many factors make the process extremely delicate for each operator to control.

The Yu process is also fraught with another problem. Should an operator decide to vary the application of the heat reduction effect from one side of the ingot to another, there is no way for him to do so because the gas-infused coolant is distributed uniformly throughout the mold and he has no means with which to vary the composition of it from one point to another. The coolant is simply gas-infused at all points in the same mix provided at the make-up tank, and there is no way to vary from this, or to achieve different geometrical results from one cast to another.

SUMMARY OF THE INVENTION

Like Yu, the means and technique of the present invention infuses the liquid coolant with gas, but the gas is added in the passage, and is added as discrete, undissolved bubbles of the same which are in no way subjected to pressure that would force them into solution. To the contrary, they tend to remain as discrete, undissolved bubbles of gas in the coolant, and to discharge through the aperture and impinge on the emerging ingot in the same condition. Unlike Yu, therefore, the coolant exits through the aperture in a discontinuous liquid phase, rather than a substantially continuous liquid phase.

This is not the first time, however, that the coolant has been infused with gas during its tenure in the passage. Throughout the process of his U.S. Pat No. 4,693,298, Wagstaff discharged ordinary, unmodified coolant through a passage that opened into the exit end of the mold at an aperture therein; but at times, he released a body of pressurized gas into the passage with the coolant so that the gas would increase the velocity of the coolant and destroy — not generate — any "insulative layer" of the type which Yu had sought to achieve. This in turn increased the cooling rate, rather than decreasing it, as Yu had done.

That was another invention, however, and for different purposes. In accordance with the present invention, the applicant, Wagstaff, now releases the gas into the passage in a different manner, by different means, and for a different effect, in fact for the effect obtained by Yu, whether that effect is in the form of an "insulative layer of gas," as Yu described it, or otherwise. In U.S. Pat. No. 4,693,298, Wagstaff released the body of gas through a slot which was equipped to subdivide it into a multiplicity of gas jets. The jets acted on the coolant to energize it and increase its velocity to the extent that it would destroy any insulative layer at the surface of the ingot, as mentioned. Now, however, the gas is released into the passage through a wall surface thereof, which, so to speak, "dribbles" the gas into the passage in a spittle-like state in which the gas no longer acts on the coolant, to energize it, but instead relies on the energy of the coolant to capture it and transport it to the surface of the ingot while it remains in that state. At the surface, in that state, the gas then alters the heat transfer characteristics of the coolant to vary the rate at which heat is lost from the ingot, for example, in the manner described by Yu.

To elaborate, and in accordance with the invention, a body of solid but porous, gas-permeable material is incorporated into the wall of the passage at a surface thereof which extends substantially parallel to the flow of coolant in the passage and coterminates with the exit end of the mold at the aperture to form an edge thereof. When desired, pressurized gas is forced through the body of porous material at a pressure which is less than that which is needed to dissolve it in the coolant, so that the coolant then discharges through the aperture in a discontinuous liquid phase in which it is laden with bubbles of undissolved gas that will alter the heat transfer characteristics of the coolant on the surface of the ingot to vary the rate at which heat is lost therefrom. These bubbles of undissolved gas can be thought of as small, low energy spittle-like "globules" of gas which have the capacity to form bubbles, that in a quiescent liquid, would ultimately detach and rise buoyantly to the surface of the liquid, but which in the passage, are never given a chance to do so, because the on-rushing liquid coolant promptly shears them away from the wall surface in the nascent state, and carries them forward to the aperture for discharge with the coolant onto the emerging ingot. At the ingot, the nascent bubbles then "spittle-up" the surface of the ingot and produce the insulative effect disclosed by Yu.

This "nascent bubble" phenomenon can be explained more fully by the analogy of an arrangement wherein pressurized gas is applied to the underside of a thin plate having a minute aperture therein, and a body of liquid in static condition on the upper side thereof. When the pressure of the gas pushes a globule of gas out through the aperture into the body of static liquid, the phenomenon of surface tension "skins over" the globule to assure that it remains intact and attached to the upper surface of the plate while more and more gas is added to it. Ultimately, however, the bubble attains sufficient buoyancy to detach from the plate and float to the surface of the liquid. Of course, the smaller the aperture through which the globule is expressed into the liquid, the smaller will be the bubble which is formed and pressurized before it detaches and becomes a free-floating bubble. Suppose, however, that instead of the liquid being in a relatively quiescent state, it is in fact rushing over the upper side of the plate and prone to peel off or shear off each globule of gas before it attains sufficient buoyancy to detach and escape from the surface of the plate. Such a "nascent bubble" will be "captured" by the on-rushing liquid before it even attains the character needed to detach and float to the surface. The problem is, however, how does one generate a mass of such minutely small "nascent bubbles" in a stream of liquid coolant destined to impinge on an ingot emerging from a mold cavity?

As indicated, the present invention answers this problem through the mechanism of forcing the gas through a body of solid but porous, gas-permeable material, and to illustrate, the porous, gas-permeable material may be a sintered particle material. "Sintering," of course, achieves a weld or bond between particles, but in advance of the melt temperature of the particle material, so that interstitial spaces remain among the particles by which a gas can be forced through the body of the same from one surface thereof to another. The sintered particle material may be a ceramic or plastic material, or any one of several intermediate graphite materials, but preferably comprises sintered metal particles. In fact, stainless steel particle material is presently employed in fabricating the body of porous material.

In many of the presently preferred embodiments of the invention, the body of porous material is incorporated in the wall of the passage so that one surface of the body defines a substantial portion of the surface of the wall, parallel to the flow of coolant in the passage. In some embodiments, the body of porous material is recessed in a socket formed at a point on the surface of the wall. In other embodiments, the body of porous material is annular and recessed in a counterbore formed about the surface of the wall. In certain of the latter, moreover, the body of porous material is tubular, and the counterbore and body are substantially coextensive with the wall of the passage, so that the body defines the surface of the same at the inner periphery thereof.

Often, the body of porous material is cylindrical, and the gas is forced into the same either at one axial end thereof, or at the outer peripheral cylindrical surface thereof, depending on the whether the body is a cylindrical disc or a cylindrical torus. If a cylindrical torus, it may be donut-shaped or tube-shaped. If tube-shaped, moreover, one surface of the tube-shaped body may be sealed against transmigration of the gas thereacross, to aid in controlling the diffusion of the gas through the body.

Where the body is a cylindrical torus, often it has a circumferential groove about the outer peripheral surface thereof, to aid in forcing the gas into the same.

In most of the presently preferred embodiments of the invention, the passage opens into the exit end of the mold through an annulus that is circumposed about the end opening in the exit end of the mold, and the body of porous material is incorporated into the wall of the passage at a surface thereof which coterminates with the exit end of the mold at the annulus.

In some of the presently preferred embodiments of the invention, for example, the passage terminates in an annular slot that is circumposed about the end opening in the exit end of the mold, and the body of porous material is incorporated in the relatively outer peripheral wall of the slot, at that terminal surface of the wall which coterminates with the exit end of the mold at the mouth of the slot. In certain of these embodiments, a series of spaced bodies of porous material is arrayed about the outer peripheral wall of the slot, in the aforesaid terminal surface of the wall, and the gas is forced through each of the respective bodies. In many of them, moreover, the bodies are disc-shaped and engaged in a corresponding series of sockets in the terminal surface of the wall.

In one group of the aforementioned embodiments, the coolant is fed to the slot through a gallery of spaced holes which discharge the coolant into the slot substantially along parallels to the terminal surface of the outer peripheral wall thereof. In certain of them, the coolant is fed to the holes through an annular retention chamber which is circumposed about the cavity of the mold in the body thereof.

In one special group of embodiments, the end opening in the exit end of the mold is defined by an annular lip, and the body or bodies or porous material are incorporated into the inner peripheral edge of an annular plate which is secured to the exit end of the mold about the lip, in spaced relationship thereto, to form a slot-like passage for the coolant. The plate may be put on initially in constructing the mold, or added later for purposes of retrofitting or reconstructing such a mold with the inventive gas infusion means, in that the gas which is forced through the body or bodies of porous material may be supplied to them by means incorporated in the plate.

In certain other embodiments of the invention, the passage of the mold terminates in a gallery of spaced holes that are circumposed in an annulus about the end opening in the exit end of the mold, and the body of porous material is incorporated in the inner peripheral walls of the holes, at those terminal surfaces of the walls which coterminate with the exit end of the mold at the annulus. In some of these embodiments, a series of spaced bodies is arrayed about the inner peripheral walls of the holes, in the aforesaid terminal surfaces of the walls, and the gas is forced through each of the respective bodies. In certain of them, the holes are counterbored and the bodies are toroidal and engaged in the counterbores of the holes so as to define those end portions of the holes adjacent the annulus. The toroidal bodies may be donut shaped and coextensive with those end portions of the holes adjacent the annulus; or tube-shaped and coextensive with more of the holes, including the full lengths of the same.

As in the case of certain of the slot-discharge embodiments mentioned earlier, the coolant is fed to the discharge holes in certain of these latter embodiments, through an annular retention chamber which is circumposed about the cavity in the body of the mold.

If desired, the rate of heat loss from the ingot may be varied differently from one point to another about the perimeter of the end opening in the exit end of the mold. For example, the rate may be varied differently by discharging the coolant through a passage which opens into the exit end of the mold through an annulus that is circumposed about the end opening in the exit end of the mold and has a series of spaced bodies of porous material arrayed thereabout, the porosities of which vary from one point to another, circumferentially of the annulus.

BRIEF DESCRIPTION OF THE DRAWINGS

These features will be better understood by reference to the accompanying drawings which illustrate several of the presently preferred embodiments of the invention.

In the drawings.

BEST MODE FOR CARRYING OUT THE INVENTION

Figures 1, 3:
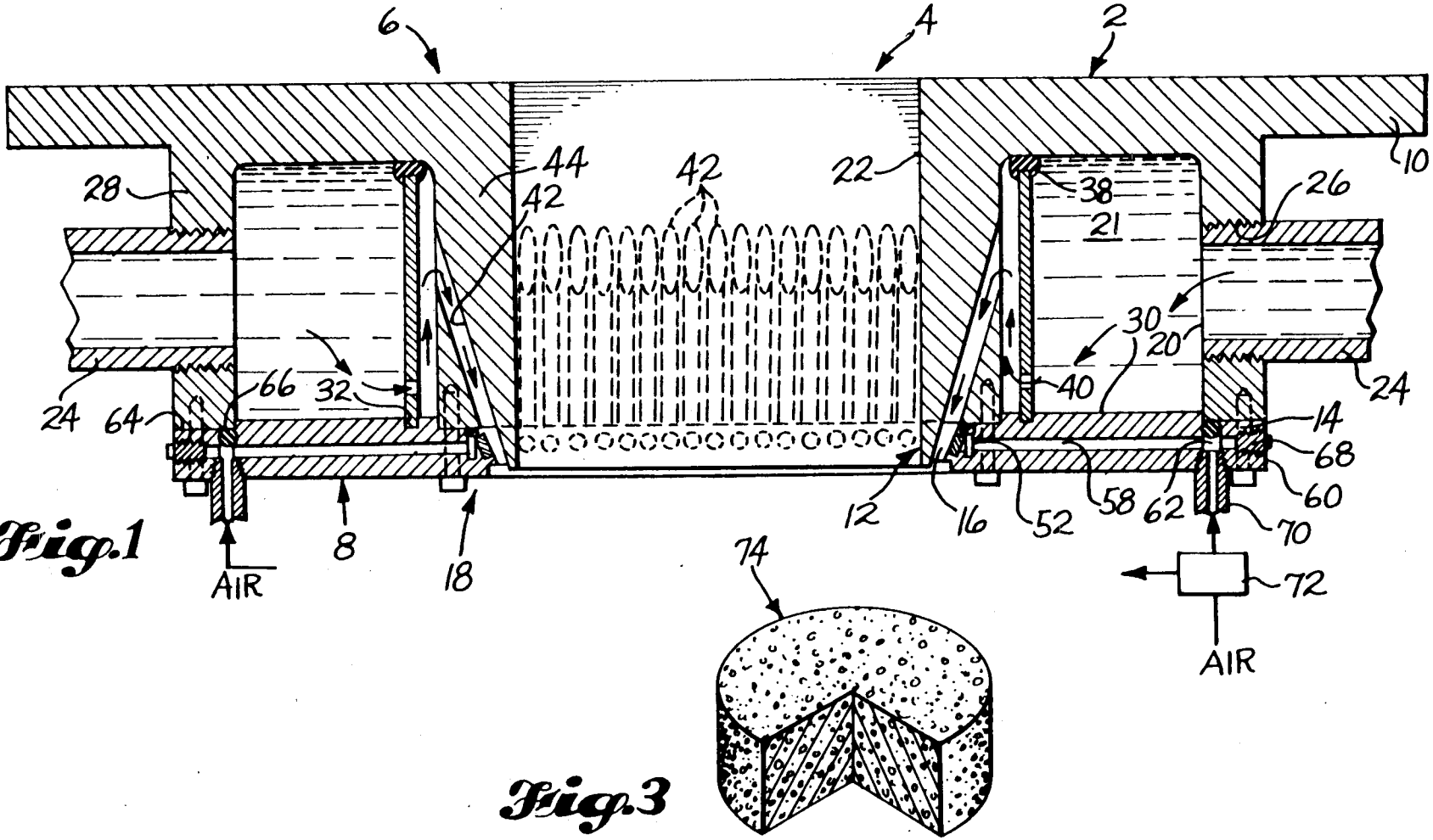
FIG. 1 is an axial cross-section of an ingot production mold having the inventive gas-infusion means connected to an annular slot about the end opening in the exit end of the mold.
FIG. 3 is a perspective view of a partially removed disc of porous, gas-permeable material employed as part of the gas-infusion means.
Figure 2:
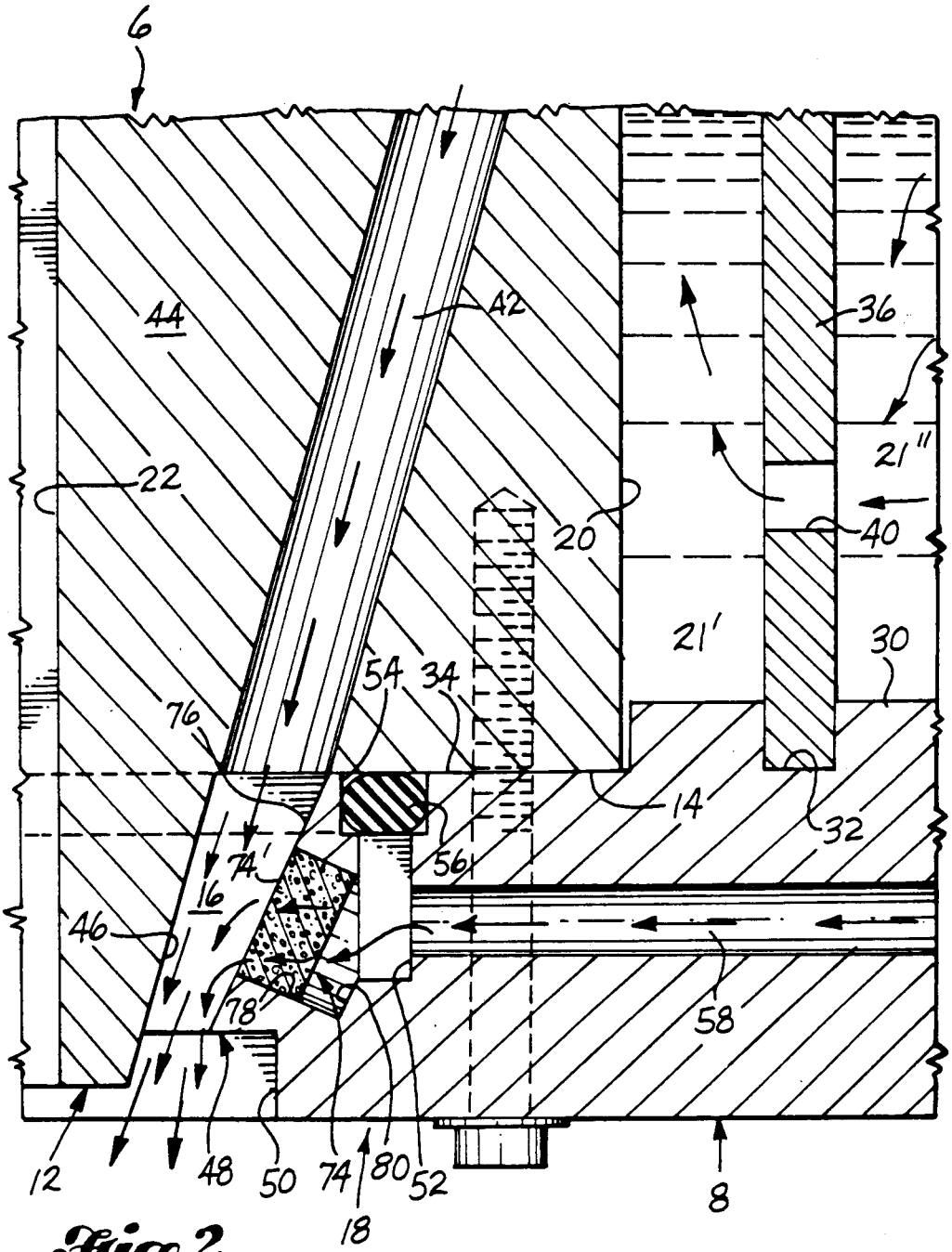
FIG. 2 is an enlarged part cross-sectional view of the mold at the end opening, highlighting the slot and the gas-infusion means connected therewith.

Referring first to FIGS. 1-3, it will be seen that the case 2 of the mold 4 has a generally rectangular outline, inside and out, and is constructed from a pair of annular parts 6 and 8, that are of similar outline. The relatively upper part 6 constitutes the main body of the case and has a flange 10 at the top thereof, and a lip 12 which depends from the underside 14 thereof at the inner peripheral edge of the same. The relatively lower part 8 is more plate-like and constitutes a cover for the underside 14 of the case, and a means with which to define the slot 16 of the mold, as shall be explained. The case 2 also has several additional components and fittings, including a gas-infusion means 18, which enable it to function not only as a direct chill mold, but also as one capable of providing a variable chill rate, as shall be explained.

More specifically, the body 6 of the case has a wide, deeply recessed annular groove 20 in the underside thereof, which is circumposed about the cavity 22 of the mold to form a chamber 21 for retaining liquid in the mold. The groove 20 is well spaced from the inner and outer peripheries of the case, and is supplied with liquid coolant by a set of pipe fittings 24 that are threadedly engaged in a corresponding set of holes 26 in the outer wall 28 of the case at the respective sides of the mold. The coolant is retained in the groove 20, meanwhile, by the cover plate 8, which is rabbeted at the inner and outer peripheral edges thereof to have an annular land 30 thereon which engages in the mouth of the groove 20 when the plate 8 is cap screwed to the underside of the body of the case as shown. In addition, the land 30 has a narrow groove 32 in the same which is annular and spaced slightly radially outwardly from the inner peripheral rabbet 34 of the plate, to receive the bottom of a baffle 36 that is arranged to upstand about the chamber at the spacing of the groove 32. The baffle 36 has an elastomeric seal 38 at the top thereof, and a series of feed holes 40 in the bottom portion thereof, which serve to interconnect the two radially inner and outer portions 21′ and 21″ of the chamber 21 formed by the baffle. The radially inner portion 21′ is narrower, and is accompanied by a gallery of holes 42 in the top portion of the inner wall 44 of the case, which are closely spaced to one another and operate to discharge the coolant from the chamber 21 at the slot 16, as shall be explained.

With particular reference now to FIG. 2, it will be seen, firstly, that the lip 12 at the inner periphery of the case has a sharply obliquely angled outer face 46, and, secondly, that the gallery of holes 42 in the wall 44 of the case is similarly sharply obliquely angled to the underside 14 thereof, so that the holes discharge at substantially the same angle as the face 46 itself. The cover plate 8, meanwhile, has a slightly greater diameter at the inner peripheral edge 48 thereof, than does the lip 12 at the face 46, so that there is a narrow slot 16 formed between the two about the circumference of the mold. The plate 8 is also slightly deeper than the lip 12, and the slot 16 is undercut at the outside thereof, by a rabbet 50 in the edge 48 of the plate 8, so that the coolant discharging from the slot 16 tends to follow the face 46 of the lip 12, rather than flare about the underside of the plate. The lip 12, meanwhile, is protected from damage in handling, because of its shorter drop.

During steady state operation of the mold, the coolant discharge from what has been described thus far, is normally sufficient. However, in the initial butt-forming stage of the operation, and possibly in other stages of the operation, it is often necessary to reduce the rate at which the ingot (not shown) is cooled; and therefore, in accordance with the invention, the mold is also equipped with means 18 for infusing the coolant with bubbles of undissolved gas which will alter the heat transfer characteristics of the coolant on the surface of the ingot, as mentioned earlier. Referring again to FIG. 2 in particular, it will be seen that the cover plate 8 has an annular groove 52 in the rabbet 34 thereof, which in turn, is countergrooved at 54 to receive an elastomeric ring 56 when the plate 8 is secured to the underside of the body of the case. At its outer periphery, the groove 52 is intercepted by a series of holes 58 which are formed in the plate, horizontally thereof, on perpendiculars to the groove 52. The holes 58 originate in the outer peripheral edge 60 of the plate (FIG. 1), and are intercepted, in turn, adjacent the edge 60, by an annular groove 62 in the outer peripheral rabbet 64 of the plate. The groove 62, like the groove 52, is countergrooved to enable a second elastomeric ring 66 to be engaged therein when the plate 8 is secured to the body of the case. The groove 62 serves as a plenum for supplying pressurized gas to the holes 58, and for this purpose plugs 68 are inserted in the holes 58, at their outer peripheral ends, and a set of air-feed lines 70 is threadedly interconnected with the bottom of the plate 8, and at the bottom of the groove 62, to supply compressed air to the same. The compressed air supply is regulated, including turned on and off, by valve means at 72. The groove 52 at the inner peripheral rabbet 34 receives the air, meanwhile, and serves as a feed-groove for a series of plug-like sintered metal discs 74 which are incorporated into the inner peripheral edge 48 of the plate 8, at the surface 76 thereof, so as to be substantially flush with the surface at one face 74' of each disc.

Referring again to FIG. 2, it will be seen that the edge 48 of the plate 8 has a gallery of cylindrical sockets 78 removed therefrom, at points about the circumference of the surface 76. The discs 74 are press-fitted into the mouths of the respective sockets 78 so as to have interference fits therewith and to be substantially flush with the surface 76, as indicated. The sockets, meanwhile, are of sufficiently greater depth than the discs, that they have pockets 80 remaining below the discs, which open into the groove 52 at the lower inside corner thereof. The discs 74 are porous and gas-permeable by nature, and when pressurized gas is supplied to the pockets 80 of the sockets 78, through the holes 58 and grooves 62, 52, the gas diffuses through the bodies of the discs and tends to escape into the slot 16 at the slotadjacent faces 74' of the discs. The escaping "globules" of gas barely form nascent bubbles of gas, however, before they are sheared off by the on-rushing coolant in the slot 16, and carried enmass with the coolant into the ambient atmosphere of the mold for application to the surface of the ingot. Video camera investigation has shown, moreover, that the resultant nascent bubble "foam" or "spittle" which is transported to the surface of the ingot with the coolant, operates to alter the heat transfer characteristics of the coolant on the surface to the extent that the heat transfer rate of the coolant is less than were it only in substantially continuous liquid phase and devoid of gas.

Preferably, the gallery of sockets and discs forms a substantially continuous "band" of the sintered metal particle material around the circumference of the slot, at the surface 76. But as a practical matter, a compromise must be worked out between achieving this effect and replicating the discs in a number and size sufficiently limited to make the manufacture of the plate 8 and/or mold practical. Therefore, the number of discs is commonly in the ratio of approximately three discs for every four holes 58. There is, however, no need to align the discs with the holes, and vice versa, and in practice various combinations of discs and holes may be used.

Figures 4, 6:
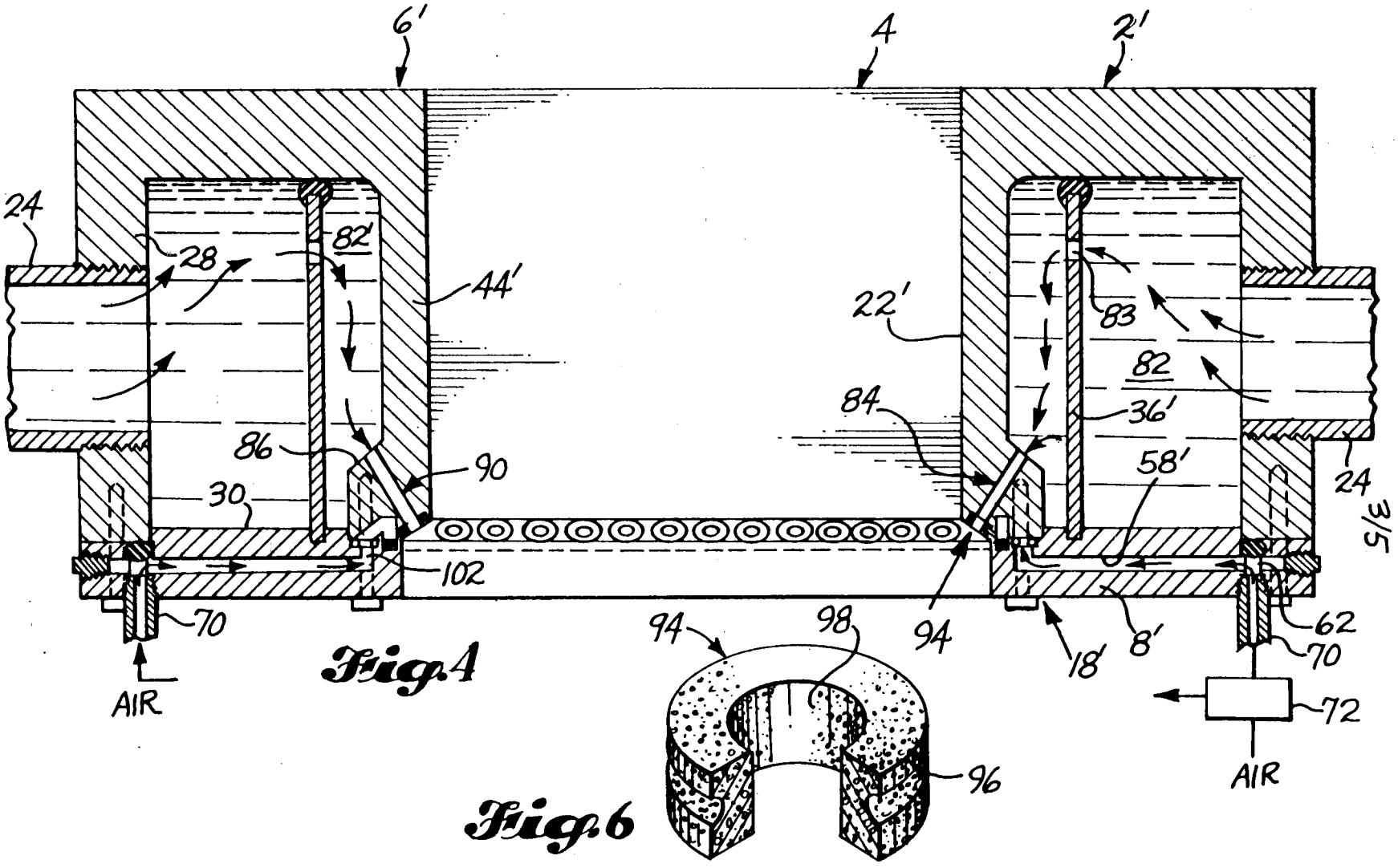
FIG. 4 is an axial cross-section of an ingot production mold having the gas-infusion means connected with a gallery of holes about the end opening in the exit end of the mold.
FIG. 6 is a perspective view of a partially removed donut of porous, gas-permeable material employed as part of the latter gas-infusion means.
Figure 5:
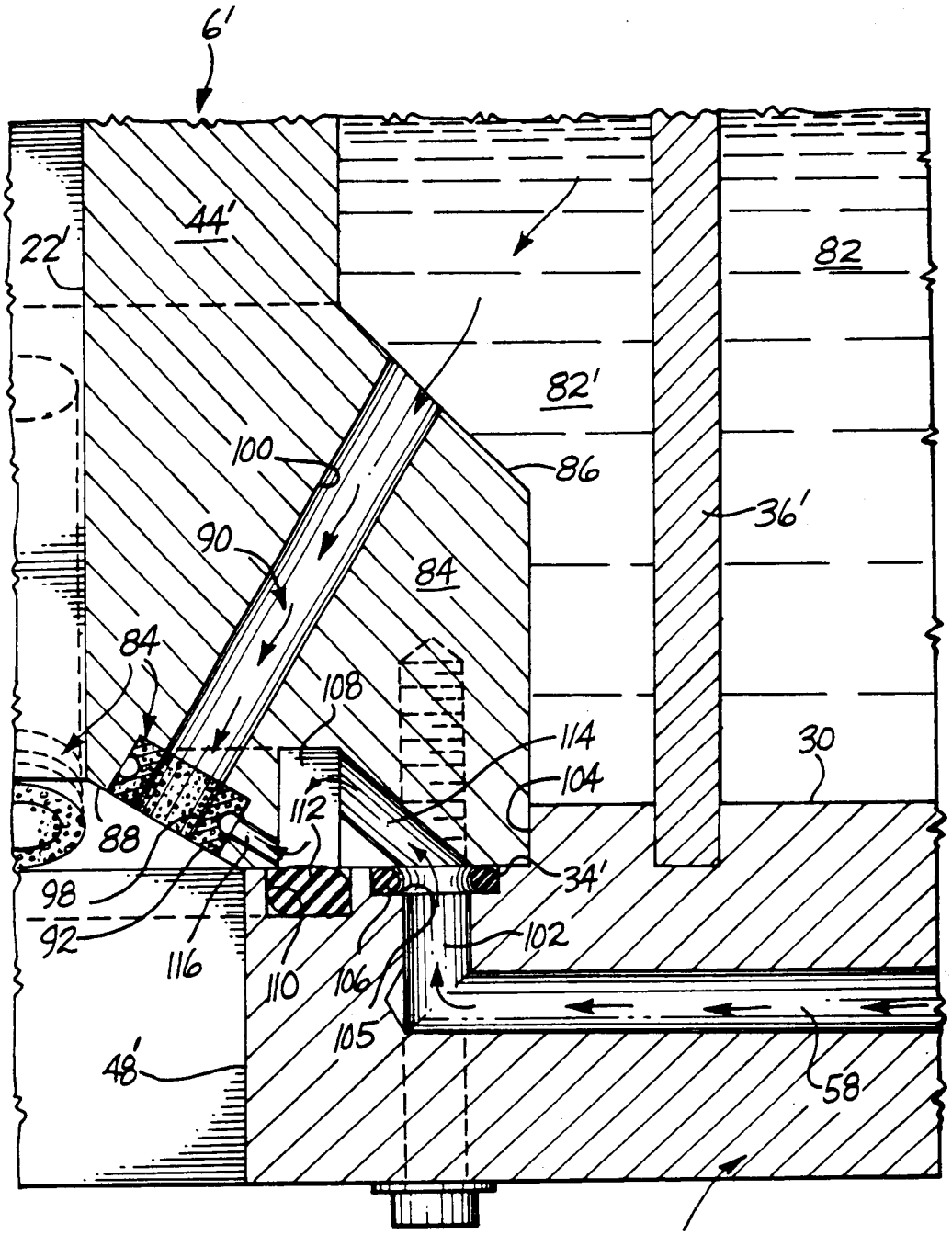
FIG. 5 is an enlarged part cross-sectional view of the mold at the end opening, highlighting the mouths of the holes and the gas-infusion means connected therewith.

Referring now to the apertured version of the mold 4' in FIGS. 4–6, it will be seen that the body 6' of the case 2' once again has a chamber 82 circumposed about the cavity 22' of the mold, to retain liquid coolant. It also has a pipe fitting 24 on each side thereof, to supply the coolant, as well as an annular baffle 36' which is perforated at 83 to circulate the coolant in reentrant fashion within the chamber 82, and a rabbeted coverplate 8' on the underside thereof, to close the chamber and provide a gas supply system 18' for the liquid coolant discharged from the chamber. However, in this instance, the inner peripheral wall 44' of the body 6' of the case is more pronounced at the bottom so as to have an enlarged foot 84 therearound, rather than the lip 12 seen in FIGS. 1–3. The foot 84 underlies the inner portion 82' of the chamber 82, and is truncated inside and outside thereof, to provide an obliquely angled shoulder 86 on the inside thereof, and a similarly obliquely angled annulus 88 on the outside thereof. A gallery of closely spaced holes 90 is removed from the foot 84, between the shoulder 86 and the annulus 88, to discharge the coolant from the inner portion 82' of the chamber onto the emerging ingot. The holes 90 are counterbored at the annulus 88, moreover, to provide seats 92 for a corresponding number of sintered metal "donuts" 94 which are press-fitted into the same, as were the discs 74 in the sockets 78 of the embodiment in FIGS. 1–3. The toroidal body of each donut 94 has a circumferential groove 96 thereabout, at the outer periphery thereof, and the groove 96 is located substantially midway of the donut, axially thereof. Each donut 94 is adapted, moreover, to fully occupy its counterbore 92, and when seated in the counterbore, the inner peripheral surface 98 of the donut is substantially flush with the wall surface 100 of the corresponding hole 90 in the foot 84 of the case. The groove 96 of the donut functions, meanwhile, as a feeder groove for compressed air which is forced into the donut from the air supply system 18' in the plate, but in a slightly different manner because of the location of the donuts 94 in the body 6' of the case, rather than in the plate 8, as in FIGS. 1–3.

Figure 7:
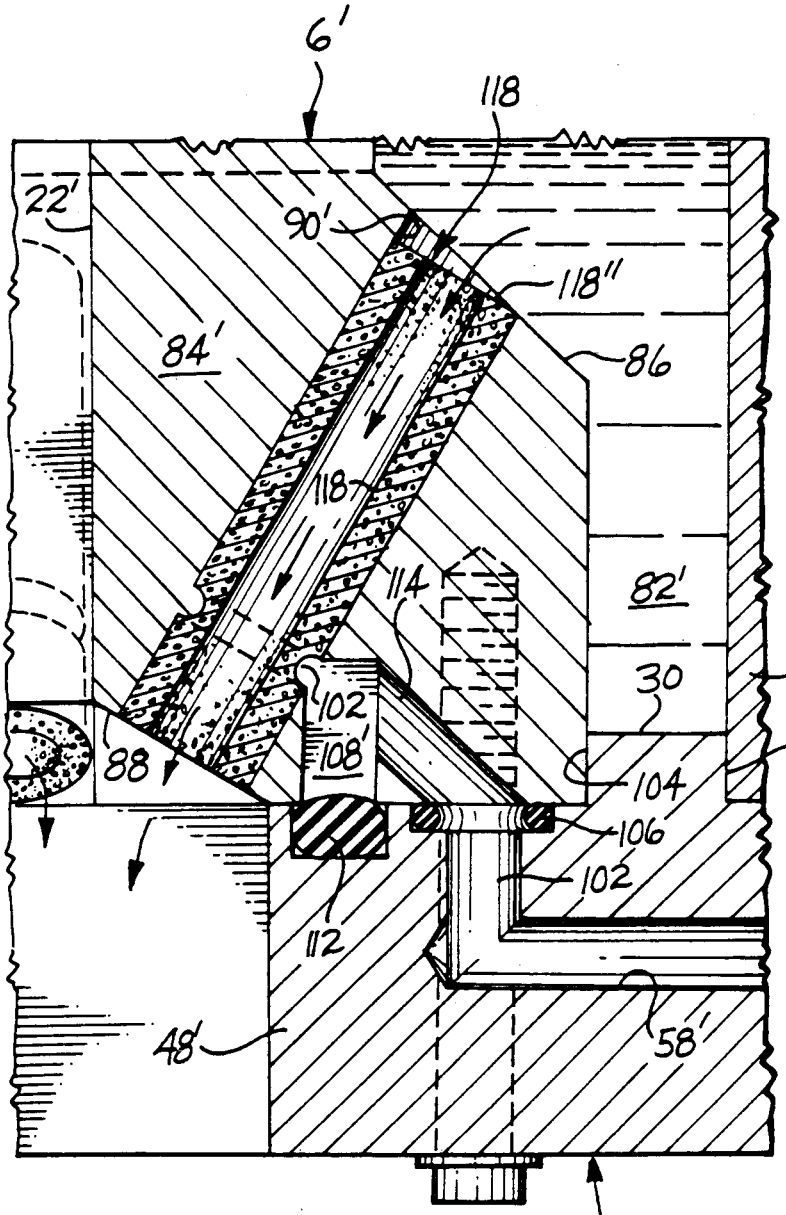
FIG. 7 is an enlarged part cross-sectional view at the end opening in the mold of FIGS. 4 and 5, but highlighting a version in which full length tubes are employed as part of the latter gas-infusion means, rather than donuts.
Figure 8:
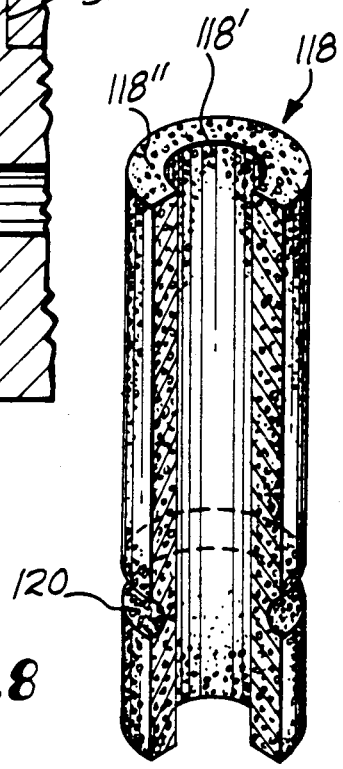
FIG. 8 is a perspective view of one partially removed, porous, gas-permeable tube employed in the version of FIG. 7.

Referring now to FIG. 5 in particular, it will be seen that in lieu of the groove 52 of the plate in FIGS. 1–3, each of the holes 58, now has a right-angular elbow 102 at the inside end of the same, and the elbow 102 opens into the inner peripheral rabbet 34' of the plate at a diameter closer to the shoulder 104 of the rabbet. Each elbow 102 is counterbored at the rabbet, moreover, so that a small individual elastomeric ring 106 can be seated about the periphery of the elbow, between the plate 8' and the foot 84 of the case. The foot, 84, meanwhile, has an annular groove 108 in the underside thereof, below the series of holes 90, and at a diameter intermediate that of the edge 48' of the plate 8' and the series of elbows 102. The groove 108 is opposed by a wider, shallower groove 110 in the rabbet 34' of the plate, and this wider, shallower groove 110 provides a seat for an elastomeric ring 112 that operates to seal the bottom of the groove 108 when the plate is secured to the body of the case. The groove 108 functions as an intermediate feed groove for the grooves 96 of the donuts, and is interconnected for this purpose with the holes 58' in the plate and the grooves 96 of the donuts, by sets of angular feed holes 114 and 116 in the foot 84. The feed holes 114 extend between the counterbores 105 of the elbows 102 and the top of the groove 108, while the feed holes 116 extend between the bottom of the groove 108 and the counterbores 92 of the holes 90. Gas thus enters the groove 108, from the holes 114, and circulates through the groove to supply the grooves 96 of the donuts through the accompanying holes 16 therebetween. The gas then escapes at the inner peripheral surface 98 of each donut, but is sheared off and swept along with the liquid coolant in the manner described for the embodiment of FIGS. 1–3. The apertured version seen in FIGS. 7 and 8 differs from that seen in FIGS. 4–6 by the fact that the holes 90' of the foot 84' are counterbored the full length thereof, to receive full-length tubes 118 of sintered metal, rather than the shallower-depth donuts 94 employed in the counterbores 92 of FIGS. 4–6. The oversized holes 90' now intercept the groove 108, moreover, at the upper inner peripheral corner thereof, and each tube 118 has a circumferential groove 120 thereabout, which is located to register with that corner when the tube 118 is press fitted in the corresponding hole 90' so as to be substantially flush with the annulus 88 of the foot. Once again, pressurized gas is forced into the sintered metal of the tube 118, at the groove 120 therein, and the gas escapes at the inner peripheral surface 118' of the tube in the form of nascent bubbles of gas which are immediately sheared off and entrained in the coolant flow, for discharge onto the emerging ingot with the coolant.

The tubes 118 may be sealed at the relatively upper ends 118'' thereof, to prevent transmigration of the gas across those ends into the chamber. Similarly, the inner peripheral surfaces 118' of the tubes may be sealed for a part of the length thereof, for example, at the relatively upper end portions thereof, above the grooves 120 therein. Any gas-impervious sealant material may be used, which can be coated or otherwise applied to the respective surfaces for this purpose.

The respective discs 74, donuts 94 and tubes 118 are commonly fashioned from batches of stainless steel particle material which are sintered to form porous, gas-permeable bodies of the same. The porosity of the bodies may be varied from one batch to another, however, so that the bodies used on one side of the mold, can differ from those used on another, to produce a different effect from one side to another, or from a side to an adjacent corner, or for whatever effect is desired. Several techniques are known in the sintering art for varying porosity, including through the selection of particle size.

The manner in which cooling is conducted, can be varied in a number of other ways as well, including varying the spacing of the porous bodies, varying the gas distribution to the same, and varying the characteristics of the gas itself, including the pressure of the same from point to point. The operator need not anticipate an upcoming stage of the casting operation, such as the change from butt formation to steady state casting, but can instantaneously commence and terminate the supply of gas to the porous bodies when desired. And since the gas-infusion process is a mechanical one, rather than a chemical one, the operator need not concern himself with the temperature of and solutes in the liquid coolant, nor with what either will do to change the solubility of the infused gas when the coolant is treated for algae growth or otherwise. In short, the inventive means and technique are free from all of the problems which were inherent in the Yu process, and as seen, also open up the possibility of retrofitting a mold for the inventive process. In addition, the invention opens up the possibility of varying the metallurgy of the ingot itself, for example, through the selection of the gas used in the gas-infusion process.

The invention is, of course, equally applicable to billet, and thus the term "ingot" is inclusive of it.

I claim:

1. In the process of direct cooling a body of partially solidified metal emerging as ingot from the exit end of an open-ended mold, by the step of discharging liquid coolant onto the surface of the ingot through a passage of the mold opening into the exit end of the mold at an aperture therein, the further steps of:

incorporating a body of solid but porous, gas-permeable material into the wall of the passage at a surface thereof which extends generally parallel to the flow of coolant in the passage and coterminates with the exit end of the mold at the aperture to form an edge thereof, and forcing pressurized gas through the body of porous, gas-permeable material at a pressure which is less than that which is needed to dissolve the gas in the coolant, so that the coolant then discharges through the aperture in a discontinuous liquid phase in which it is laden with bubbles of undissolved gas that will alter the heat transfer characteristics of the coolant on the surface of the ingot to vary the rate at which heat is lost therefrom.

2. The process according to claim 1 wherein the porous, gas-permeable material is a sintered particle material.

3. The process according to claim 2 wherein the sintered particle material comprises sintered metal particles.

4. The process according to claim 1 wherein the body of porous material is incorporated in the wall of the passage so that one surface of the body defines a substantial portion of the surface of the wall, parallel to the flow of coolant in the passage.

5. The process according to claim 1 wherein the body of porous material is recessed in a socket formed at a point on the surface of the wall.

6. The process according to claim 1 wherein the body of porous material is annular and recessed in a counterbore formed about the surface of the wall.

7. The process according to claim 6 wherein the body of porous material is tubular, and the counterbore and body are substantially coextensive with the wall of the passage, so that the body defines the surface of the same at the inner periphery thereof.

8. The process according to claim 1 wherein the body of porous material is a cylindrical disc, and the gas is forced into the same at one axial end thereof.

9. The process according to claim 1 wherein the body of porous material is a cylindrical torus, and the gas is forced into the same at the outer peripheral cylindrical surface thereof.

10. The process according to claim 9 wherein the body of porous material is donut-shaped.

11. The process according to claim 9 wherein the body of porous material is a tube-shaped.

12. The process according to claim 11 wherein one surface of the tube-shaped body is sealed against transmigration of the gas thereacross.

13. The process according to claim 9 wherein the torus has a circumferential groove about the outer peripheral cylindrical surface thereof.

14. The process according to claim 1 wherein the passage opens into the exit end of the mold through an annulus that is circumposed about the end opening in the exit end of the mold, and the body of porous material is incorporated into the wall of the passage at a surface thereof which coterminates with the exit end of the mold at the annulus.

15. The process according to claim 1 wherein the passage terminates in an annular slot that is circumposed about the end opening in the exit end of the mold, and the body of porous material is incorporated in the relatively outer peripheral wall of the slot, at that terminal surface of the wall which coterminates with the exit end of the mold at the mouth of the slot.

16. The process according to claim 15 wherein a series of spaced bodies of porous material is arrayed about the outer peripheral wall of the slot, in the aforesaid terminal surface of the wall, and the gas is forced through each of the respective bodies.

17. The process according to claim 16 wherein the bodies are disc-shaped and engaged in a corresponding series of sockets in the terminal surface of the wall.

18. The process according to claim 15 wherein the coolant is fed to the slot through a gallery of spaced holes which discharge the coolant into the slot substantially along parallels to the terminal surface of the outer peripheral wall thereof.

19. The process according to claim 18 wherein the coolant is fed to the holes through an annular retention chamber which is circumposed about the cavity of the mold in the body thereof.

20. The process according to claim 1 wherein the end opening in the exit end of the mold is defined by an annular lip, and the body of porous material is incorporated into the inner peripheral edge of an annular plate which is secured to the exit end of the mold about the lip, in spaced relationship thereto, to form a slot-like passage for the coolant.

21. The process according to claim 20 wherein the gas which is forced through the body of porous material is supplied to the body by means incorporated in the plate.

22. The process according to claim wherein the passage terminates in a gallery of spaced holes that are circumposed in an annulus about the end opening in the exit end of the mold, and the body of porous material is incorporated in the inner peripheral walls of the holes, at those terminal surfaces of the walls which coterminate with the exit end of the mold at the annulus.

23. The process according to claim 22 wherein a series of spaced bodies is arrayed about the inner peripheral walls of the holes, in the aforesaid terminal surfaces of the walls, and the gas is forced through each of the respective bodies.

24. The process according to claim 23 wherein the holes are counterbored, and the bodies are toroidal and engaged in the counterbores of the holes so as to define those end portions of the holes adjacent the annulus.

25. The process according to claim 24 wherein the toroidal bodies are donut-shaped and coextensive with those end portions of the holes adjacent the annulus.

26. The process according to claim 24 wherein the toroidal bodies are tube-shaped and coextensive with the full lengths of the holes.

27. The process according to claim 22 wherein the coolant is fed to the holes through an annular retention chamber which is circumposed about the cavity in the body of the mold.

28. The process according to claim 1 wherein the rate of heat loss from the ingot is varied differently from one point to another about the perimeter of the end opening in the exit end of the mold.

29. The process according to claim 28 wherein the rate is varied differently by discharging the coolant through a passage which opens into the exit end of the mold through an annulus that is circumposed about the end opening in the exit end of the mold and has a series of spaced bodies of porous material arrayed thereabout, the porosities of which vary from one point to another, circumferentially of the annulus.

30. In the process of constructing an open-ended mold from which a body of partially solidified metal can be operatively withdrawn as ingot at the exit end of the mold, and liquid coolant can be discharged onto the surface of the ingot through a passage of the mold opening into the exit end of the mold at an aperture therein, the steps of:

incorporating a body of solid but porous, gas-permeable material into the wall of the passage at a surface thereof which is adapted to extend generally parallel to the flow of coolant in the passage and coterminates with the exit end of the mold at the aperture to form an edge thereof, and providing means for forcing pressurized gas through the body of porous material at a pressure which is less than that which is needed to dissolve the gas in the coolant, so that the coolant will discharge through the aperture in a discontinuous liquid phase in which it is laden with bubbles of undissolved gas that will alter the heat transfer characteristics of the coolant on the surface of the ingot to vary the rate at which heat is lost therefrom.

31. The process according to claim 30 wherein the end opening in the exit end of the mold is defined by an annular lip, the body of porous material is incorporated into the inner peripheral edge of an annular plate which is secured to the exit end of the mold about the lip, in spaced relationship thereto, to form a slot-like passage for the coolant, and the means for forcing pressurized gas through the body of porous material are incorporated into the plate.

32. A component with which to define the outer peripheral wall of an annular slot that is formed about the exit end of an open ended metal ingot casting mold for use in discharging liquid coolant onto the ingot emerging from the end of the mold, comprising:

an annular plate, the body of which is constructed of gas impermeable material but has a series of sockets arrayed in spaced relationship to one another about the inner peripheral edge thereof, each of which has a plug of porous, gas permeable material engaged therein so that one face of the respective plug is flush with the surface of the edge, said plate having means in the body thereof defining an annular plenum that extends about the series of sockets and is in communication with each socket on that side of the plug therein which is opposed to the one face thereof, and said plate also having means on the outer peripheral portion of the body thereof whereby a pressurized gas can be charged into the plenum for discharge through the respective plugs of gas permeable material at the one faces thereof when the plate is secured to the mold about the exit end thereof to form the outer peripheral wall of the slot.

33. The construction component according to claim 32 wherein the top and bottom of the plate are substantially parallel to one another, and the inner peripheral edge of the plate is acutely inwardly inclined to the same, from the top to the bottom of the plate, with disc-shaped plugs in the sockets thereof.

34. A component with which to construct an open-ended molded from which a body of partially solidified metal can be operatively withdrawn as ingot at the exit end of the mold, and liquid coolant can be discharged onto the surface of the ingot through a passage of the mold opening into the exit end of the mold at an aperture therein, comprising:

an annular case, one axial end of which has a gallery of spaced holes circumposed in an annulus about the end opening in the one axial end of the case, a body of solid but porous, gas-permeable material incorporated in the inner peripheral walls of the holes, at those terminal surfaces of the walls which coterminate with the one axial end of the case at the annulus, and means for forcing pressurized gas through the body of porous material when the liquid coolant is discharged through the gallery of holes in the operation of the mold.

35. The construction component according to claim 34 wherein a series of spaced bodies is arrayed about the inner peripheral walls of the holes, in the aforesaid terminal surfaces of the walls, and the gas-forcing means are operative to force gas through each of the respective bodies.

36. In an open-ended mold from which a body of partially solidified metal is operatively withdrawn as ingot at the exit end of the mold, and liquid coolant is discharged onto the surface of the ingot through a passage of the mold opening into the exit end of the mold at an aperture therein, the improvement comprising:

a body of solid but porous, gas-permeable material incorporated into the wall of the passage at a surface thereof which extends generally parallel to the flow of coolant in the passage and coterminates with the exit end of the mold at the aperture to form an edge thereof, and means for forcing pressurized gas through the body of porous material at a pressure which is less than that which is needed to dissolve the gas in the coolant, so that the coolant will then discharge through the aperture in a discontinuous liquid phase in which it is laden with bubbles of undissolved gas that will alter the heat transfer characteristics of the coolant on the surface of the ingot to vary the rate at which heat is lost therefrom.

37. The open-ended mold according to claim 36 wherein the porous, gas-permeable material is a sintered particle material.

38. The open-ended mold according to claim 36 wherein the body of porous material is incorporated in the wall of the passage so that one surface of the body defines a substantial portion of the surface of the wall, parallel to the flow of coolant in the passage.

39. The open-ended mold according to claim 36 wherein the surface of the wall has a socket formed at a point thereon, and the body of porous material is recessed in the socket.

40. The open-ended mold according to claim 36 wherein the wall of the passage has a counterbore formed about the surface thereof, and the body of porous material is annular and recessed in the counterbore.

41. The open-ended mold according to claim 40 wherein the body of porous material is tubular, and the counterbore and body are substantially coextensive with the wall of the passage, so that the body defines the surface of the same at the inner periphery thereof.

42. The open-ended mold according to claim 36 wherein the body of porous material is cylindrical and the gas forcing means are operative to force the gas into the body of porous material at one axial end thereof.

43. The open-ended mold according to claim 36 wherein the body of porous material is cylindrical and the gas-forcing means are operative to force the gas into the body of porous material at the outer peripheral cylindrical surface of the body.

44. The open-ended mold according to claim 43 wherein one surface of the body is sealed against transmigration of the gas thereacross.

45. The open-ended mold according to claim 43 wherein the body has a circumferential groove about the outer peripheral cylindrical surface thereof.

46. The open-ended mold according to claim 36 wherein the passage opens into the exit end of the mold through an annulus that is circumposed about the end opening in the exit end of the mold, and the body of porous material is incorporated into the wall of the passage at a surface thereof which coterminates with the exit end of the mold at the annulus.

47. The open-ended mold according to claim 36 wherein the passage terminates in an annular slot that is circumposed about the end opening in the exit end of the mold, and the body of porous material is incorporated in the relatively outer peripheral wall of the slot, at that terminal surface of the wall which coterminates with the exit end of the mold at the mouth of the slot.

48. The open-ended mold according to claim 47 wherein a series of spaced bodies of porous material is arrayed about the outer peripheral wall of the slot, in the aforesaid terminal surface of the wall, and the gas-forcing means are operative to force the gas through each of the respective bodies.

49. The open-ended mold according to claim 48 wherein the terminal surface of the wall has a corresponding series of sockets therein, and the bodies are disc-shaped and engaged in the sockets.

50. The open-ended mold according to claim 47 further comprising a gallery of spaced holes which are adapted to feed the coolant to the slot and to discharge the coolant into the slot substantially along parallels to the terminal surface of the outer peripheral wall thereof.

51. The open-ended mold according to claim 50 further comprising an annular retention chamber which is circumposed about the cavity of the mold in the body thereof and adapted to feed the coolant to the holes.

52. The open-ended mold according to claim 47 wherein the end opening in the exit end of the mold is defined by an annular lip, and the slot for the coolant is formed by an annular plate which is secured to the exit end of the mold about the lip, in spaced relationship thereto, and has the body of porous material incorporated into the inner peripheral edge thereof.

53. The open-ended mold according to claim 52 wherein the gas-forcing means are incorporated in the plate.

54. The open-ended mold according to claim 36 wherein the passage terminates in a gallery of spaced holes that are circumposed in an annulus about the end opening in the exit end of the mold, and the body of porous material is incorporated in the inner peripheral walls of the holes, at those terminal surfaces of the walls which coterminate with the exit end of the mold at the annulus.

55. The open-ended mold according to claim 54 wherein a series of spaced bodies is arrayed about the inner peripheral walls of the holes, in the aforesaid terminal surfaces of the walls, and the gas-forcing means are operative to force the gas through each of the respective bodies.

56. The open-ended mold according to claim 55 wherein the holes are counterbored, and the bodies are toroidal and engaged in the counterbores of the holes so as to define those end portions of the holes adjacent the annulus.

57. The open-ended mold according to claim 56 wherein the toroidal bodies are donut-shaped and coextensive with those end portions of the holes adjacent the annulus.

58. The open-ended mold according to claim 56 wherein the toroidal bodies are tube-shaped and coextensive with the full lengths of the holes.

59. The open-ended mold according to claim 54 further comprising an annular retention chamber which is circumposed about the cavity in the body of the mold and adapted to feed the coolant to the holes.

60. The open-ended mold according to claim 36 further comprising means for varying rate of heat loss from the ingot differently from one point to another about the perimeter of the end opening in the exit end of the mold.

61. The open-ended mold according to claim 60 wherein the coolant is discharged through a passage which opens into the exit end of the mold through an annulus that is circumposed about the end opening in the exit end of the mold, and the annulus has a series of spaced bodies of porous material arrayed thereabout, the porosities of which vary from one point to another, circumferentially of the annulus.

62. In an open-ended mold from which a body of partially solidified metal is operatively withdrawn as ingot at the exit end of the mold, means defining a passage through which liquid coolant is transported in the mold, means for feeding liquid coolant to the passage, a body of solid but porous, gas-permeable material incorporated into the wall of the passage at a surface thereof which extends generally parallel to the flow of coolant in the passage, and means for forcing pressurized gas through the body of porous, gas-permeable material at a pressure which is less than that which is needed to dissolve the gas in the coolant, so that the coolant then flows through the passage in a discontinuous liquid phase in which it is laden with bubbles of undissolved gas that will alter the heat transfer characteristics of the coolant.

63. The open-ended mold according to claim 62 wherein the passage opens into the exit end of the mold at an aperture therein, to discharge the coolant onto the ingot while the coolant is in the discontinuous phase, and the aforesaid surface of the wall of the passage coterminates with the exit end of the mold at the aperture to form an edge thereof.

* * * * *

UNITED STATES PATENT AND TRADEMARK OFFICE

CERTIFICATE OF CORRECTION

PATENT NO. : 5,040,595

DATED : August 20, 1991

INVENTOR(S) : Frank E. Wagstaff

It is certified that error appears in the above-identified patent and that said Letters Patent is hereby corrected as shown below:

Column 11 line 53, in Claim 22, after the word "claim", add --1--

Signed and Sealed this

Seventh Day of September, 1993

Bruce Lehman

*Attest:*

BRUCE LEHMAN

*Attesting Officer*

*Commissioner of Patents and Trademarks*